US011187401B1

(12) United States Patent
Gable et al.

(10) Patent No.: US 11,187,401 B1
(45) Date of Patent: Nov. 30, 2021

(54) LIGHTING DEVICE FOR AN AERIAL WORK PLATFORM

(71) Applicant: Klein Tools, Inc., Lincolnshire, IL (US)

(72) Inventors: Clayton J. Gable, Grayslake, IL (US); Kozeta C. Topchian, Kildeer, IL (US); Eric Salinas, Platine, IL (US); Scott M. Hargis, Northbrook, IL (US); John H. Kargenian, Prospect Heights, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 0 days.

(21) Appl. No.: 16/885,490

(22) Filed: May 28, 2020

(51) Int. Cl.

| | |
|---|---|
| ***F21V 21/088*** | (2006.01) |
| ***F21S 9/02*** | (2006.01) |
| ***B66F 17/00*** | (2006.01) |
| ***F21L 4/04*** | (2006.01) |
| *F21Y 105/18* | (2016.01) |
| *F21Y 115/10* | (2016.01) |

(52) U.S. Cl.
CPC ..... *F21V 21/088* (2013.01); *B66F 17/006* (2013.01); *F21L 4/04* (2013.01); *F21S 9/02* (2013.01); *F21V 21/0885* (2013.01); *F21Y 2105/18* (2016.08); *F21Y 2115/10* (2016.08)

(58) Field of Classification Search
CPC .... F21V 21/08; F21V 21/0885; F21V 21/088; F21V 21/14; F21V 21/145; F21V 21/34; F21S 9/02; F21S 8/037; B66F 17/006; F21L 4/04
See application file for complete search history.

(56) References Cited

U.S. PATENT DOCUMENTS

| | | | | |
|---|---|---|---|---|
| 2006/0083008 | A1* | 4/2006 | Yu | F21V 21/088 362/396 |
| 2013/0292203 | A1* | 11/2013 | Cummings | B66F 11/04 182/18 |
| 2017/0138575 | A1* | 5/2017 | Harvey | F21V 21/0885 |
| 2019/0017662 | A1* | 1/2019 | Zheng | F21V 21/0885 |
| 2019/0314957 | A1* | 10/2019 | Li | B25B 5/06 |

* cited by examiner

*Primary Examiner* — Rajarshi Chakraborty
*Assistant Examiner* — Nathaniel J Lee

(57) ABSTRACT

A battery powered lighting device is configured to be attached to a lift bucket having sidewalls and an upper lip extending from uppermost portions of the sidewalls. The lighting device includes a main housing, a securing member, and a main light mounted to the main housing and located to illuminate areas outside of the lift bucket. The main housing includes a first securing surface includes a pair of planar portions spaced from each other by a concave portion. The planar portions are configured to engage a planar surface of a sidewall or the upper lip of the lift bucket. The concave portion is configured to engage a convex surface of a sidewall or the upper lip located at a corner of the lift bucket.

20 Claims, 7 Drawing Sheets

LIGHTING DEVICE FOR AN AERIAL WORK PLATFORM

CROSS-REFERENCE TO RELATED APPLICATIONS

None

BACKGROUND OF THE DISCLOSURE

The present disclosure relates to lighting systems specifically designed for use on the aerial work platforms, commonly referred to as lift buckets, having sidewalls and an upper lip. Such lift buckets are typically electrically insulated and are provided on lift trucks to elevate liner workers in the power distribution, telephone line, and cable service industries so that the line workers can service and install elevated power lines, telephone lines, and cable lines. Other types of workers, such as arborists, that must work at height to perform their jobs also often utilize such work platforms.

Such lighting systems are known, but there is a continuing desire for improved lighting systems that offer benefits in the way of enhanced performance, improved ergonomics, additional features, and/or optimized flexibility in the application and use of the lighting system.

BRIEF SUMMARY OF THE DISCLOSURE

In accordance with one feature of this disclosure, a battery powered lighting device is configured to be releasably attached to an aerial work platform in the form of a lift bucket having sidewalls and an upper lip extending from uppermost portions of the sidewalls. The lighting device includes a main housing, a securing member, and a main light mounted to the main housing and located to illuminate areas outside of the lift bucket. The main housing includes a battery mount configured to mount a battery to power the lighting device, a first securing surface configured to engage a sidewall or the upper lip of the lift bucket, and an upper housing portion configured to be located above the upper lip of the lift bucket with the first securing surface engaged against a sidewall or the upper lip of the lift bucket. The first securing surface includes a pair of planar portions spaced from each other by a concave portion. The planar portions are configured to engage a planar surface of a sidewall or the upper lip of the lift bucket. The concave portion is configured to engage a convex surface of a sidewall or the upper lip located at a corner of the lift bucket. The securing member includes a second securing surface. The securing member extends from the upper housing portion to locate the second securing surface to engage a surface of a sidewall or the upper lip of the lift buck on an opposite side from a surface of the sidewall or the upper lip engaged by the first securing surface.

In one feature, the securing member is mounted to the upper housing portion to move between: an open position wherein a sidewall or the upper lip of the lift bucket can be inserted between the first and second securing surfaces; and a clamping position wherein the sidewall or the upper lip is clamped between the first and second securing surfaces with the upper housing portion located above the lip of the lift bucket.

In a further feature, the securing member is mounted to the upper housing portion to translate relative to the first securing surface.

As one feature, the securing member is biased toward the open position.

According to one feature, the lighting device further includes a spring mounted between the upper housing portion and the securing member and configured to bias the securing member toward the open position, with the securing member being mounted to the upper housing to translate relative to the first securing surface.

In one feature, the lighting device further includes a releasable ratchet mechanism mounted between the securing member and the upper housing portion and configured to releasably retain the securing member in the clamping position.

As a further feature, the lighting device of claim further includes an additional light located on the device to illuminate an interior of the lift bucket with a sidewall or the upper lip of the lift bucket clamped between the first and second securing surface.

In one feature, the main light is mounted to move relative to the main housing between a lower position wherein the main light is positioned below the upper housing portion and an upper position wherein the main light is positioned above the upper housing portion.

According to one feature, the battery mount includes a compartment that encloses a battery mounted in the battery mount.

As one feature, the battery mount includes a releasable connection to allow a battery to be releasably connected to the lighting device.

In one feature, the main light is an array of light emitting diodes.

As one feature, the concave portion has an arcuate profile.

According to one feature, the second securing surface is aligned opposite the first securing surface.

In accordance with one feature of this disclosure, a battery powered lighting device is configured to be releasably attached to an aerial work platform in the form of a lift bucket having sidewalls and an upper lip extending from uppermost portions of the sidewalls. The lighting device includes a main housing, a clamp member, and a main light mounted to the main housing and located to illuminate areas outside of the lift bucket. The main housing includes a battery mount configured to mount a battery to power the lighting device, a first clamp surface configured to engage a sidewall or the upper lip of the lift bucket, and an upper housing portion configured to be located above the upper lip of the lift bucket with the first clamp surface engaged against a sidewall or the upper lip of the lift bucket. The first clamp surface includes a pair of planar portions spaced from each other by a concave portion. The planar portions are configured to engage a planar surface of a sidewall or the upper lip of the lift bucket. The concave portion is configured to engage a convex surface of a sidewall or the upper lip located at a corner of the lift bucket. The clamp member includes a second clamp surface and is mounted to the upper housing portion to move between an open position wherein a sidewall or the upper lip of the lift bucket can be inserted between the first and second clamp surfaces and a clamping position wherein the sidewall or the upper lip is clamped between the first and second clamp surfaces with the upper housing portion located above the lip of the lift bucket.

In one feature, the clamp member is mounted to the upper housing to translate relative to the first clamp surface.

As one feature, the clamp member is biased toward the open position.

According to one feature, the lighting device further includes a spring mounted between the upper housing portion and the clamp member and configured to bias the clamp member toward the open position with the clamp member mounted to the upper housing to translate relative to the first clamp surface.

As one feature, the lighting device further includes a releasable ratchet mechanism mounted between the clamp member and the upper housing portion and configured to releasably retain the clamp member in the clamping position. The ratchet mechanism includes: an elongate, multi-toothed rack mounted to one of the clamp member and the upper housing portion; and a pawl mounted to the other of the clamp member and the upper housing portion.

In one feature, the lighting device further includes an additional light located on the device to illuminate an interior of the lift bucket with a sidewall or the upper lip of the lift bucket clamped between the first and second clamp surface.

According to one feature, the main light is mounted to move relative to the main housing between a lower position wherein the main light is positioned below the upper housing portion and an upper position wherein the main light is positioned above the upper housing portion.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 2:
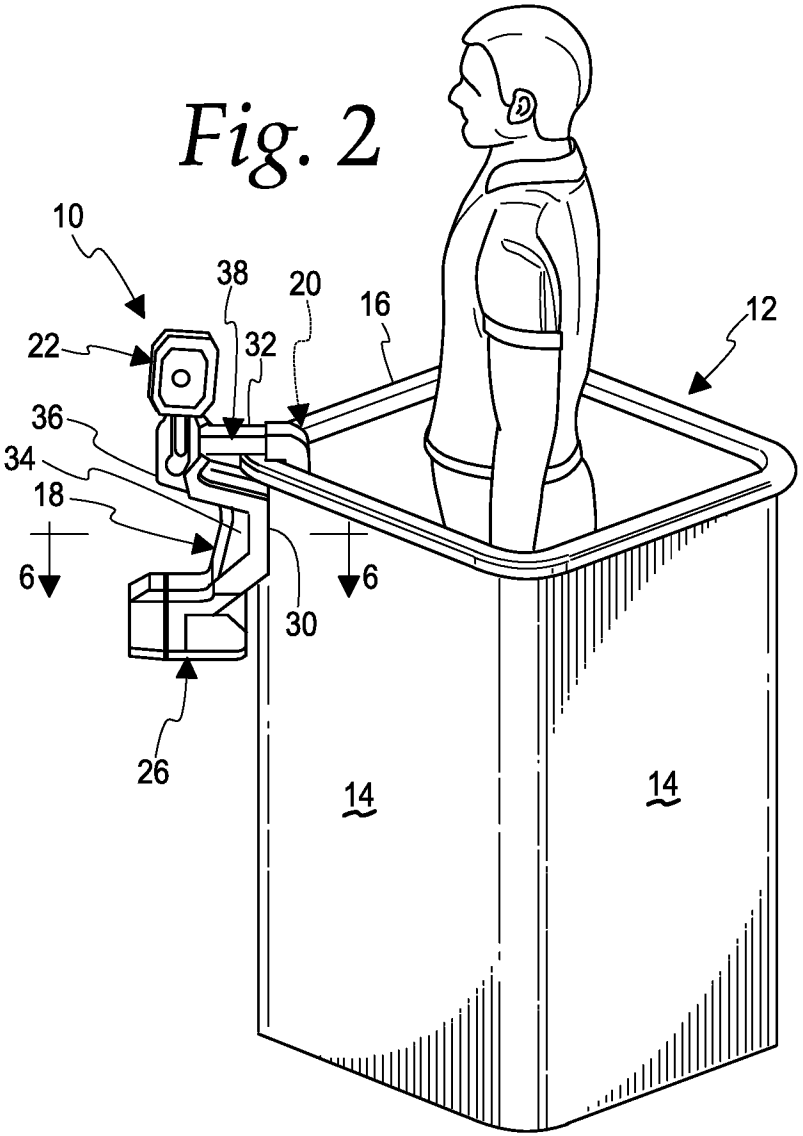
FIG. 2 is a perspective view from the left and above of the lighting device, lift bucket and user shown in FIG. 1, but with a main light shown in an upper position and swiveled to face left.
Figure 1:
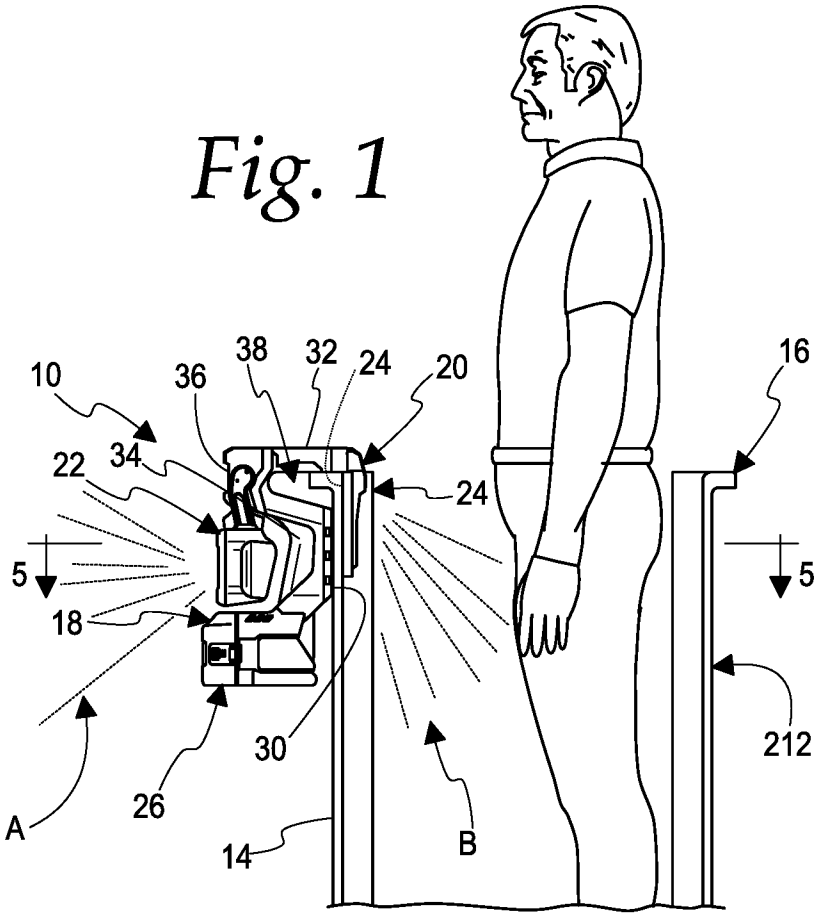
FIG. 1 is a left side elevation view of a lighting device with a main light in a lower position facing forward according to this disclosure mounted on a lift bucket together with a user in the lift bucket, with the lift bucket shown in section for purposed of illustration.

As best seen in FIGS. 1 and 2, a battery powered lighting device 10 is provided to be releasably attached to an aerial work platform 12 in the form of a lift bucket 12 having sidewalls 14 and an upper lip 16. Such lift buckets 12 are well known in various sizes and configurations, including electrically insulated configurations. The light device 10 is configured to be releasably attached to one of the sidewalls 14 or the lip 16 of the lift bucket 12.

The lighting device 10 includes a main housing 18, a securing member 20, a main light 22, and, in the illustrated embodiment, an interior light 24. The main light is mounted to the main housing 18 and located to illuminate areas outside of a lift bucket 12 with the lighting device 10 attached to one of the sidewalls 14 or the lip 16 of the lift bucket 12, as illustrated at A in FIG. 1. The interior light 24 is mounted on the securing member 20 and is located to illuminate the interior of the lift bucket 12 with the light device 10 attached to one of the sidewalls 14 or the lip 16 of the lift bucket 12, as illustrated at B in FIG. 1.

The main housing 18 includes: a battery mount portion 26 configured to mount a battery 28 (shown only in FIG. 14) to power the lighting device 10; a first securing surface 30 configured to engage a sidewall 14 or the lip 16 of the lift bucket 12; and an upper housing portion 32 configured to be located above the upper lip 16 of the lift bucket 12 with the first securing surface 30 engaged against a sidewall 14 of the upper lip 16. For purposes of terminology, as illustrated in FIG. 1, the main light 22 is located at the front of the device 10 and is facing forward, the interior light 22 is located at the rear of the device 10 and is facing in downward and rearward, the battery mount portion 26 is located at the bottom of the main housing 18, and the upper housing portion is located at the top of the main housing 18. The main housing 18 further includes a securing portion 34 that extends in an upward direction from the battery mount portion 26, and a main light mount portion 36 that extends in a forward direction from the securing portion 34 and then an upward direction to the upper housing portion 32. In the illustrated and preferred embodiment, the upper housing portion 32 extends in a rearward direction from the portion 36 and, together with the portion 36, defines a deep, u-shaped channel 38 that receives the upper lip 16 when the lighting device is attached to a sidewall 14 of the bucket 12, which is the preferred mounting configuration for the illustrated embodiment. The main housing 18 is a rigid structure and, in the illustrated embodiment, is an assembly that includes two rigid half housing components 40 and 42 that when assembled define all of the housing portions 26, 32, 34, and 36, as best seen in FIGS. 3 and 4.

Figure 3:
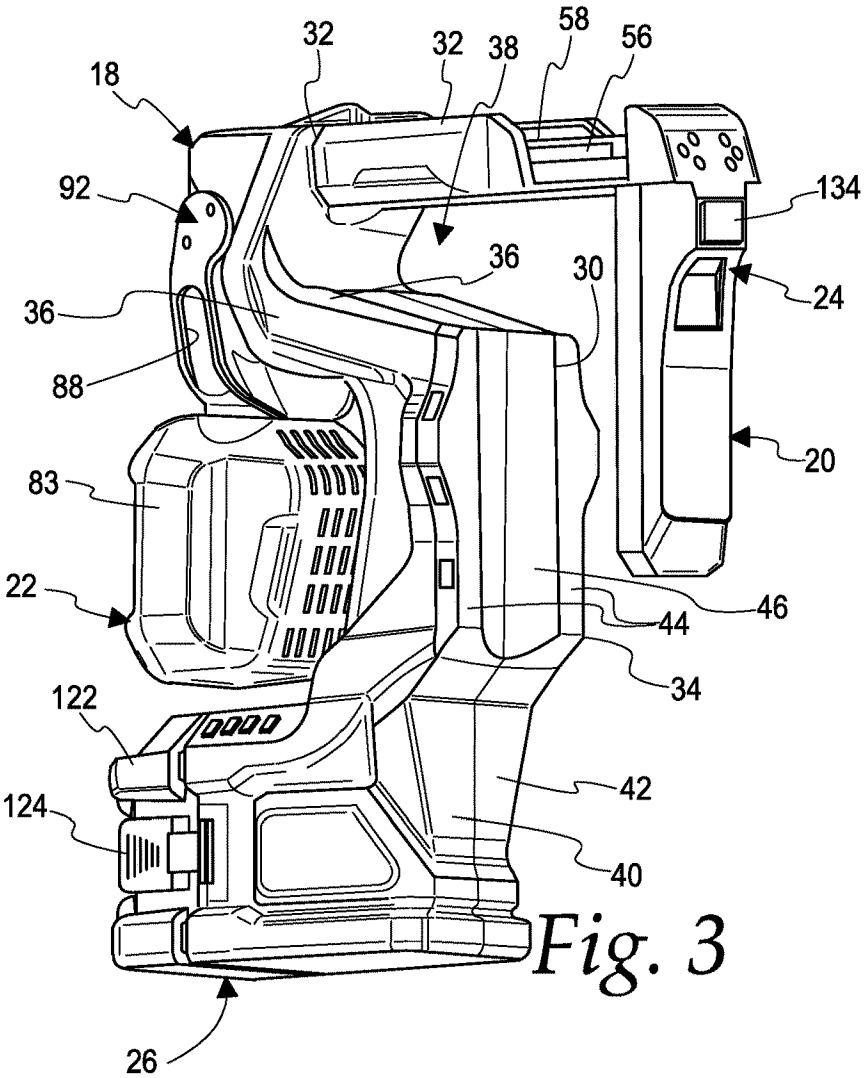
FIG. 3 is a perspective view from below and the back-left of the lighting device of FIGS. 1 and 2 with the main light in the lower position and facing forward.

In the illustrated and preferred embodiment, the securing surface 30 includes a pair of planar portions 44 spaced from each other by a concave portion 46, as best seen in FIG. 3.

Figure 5:
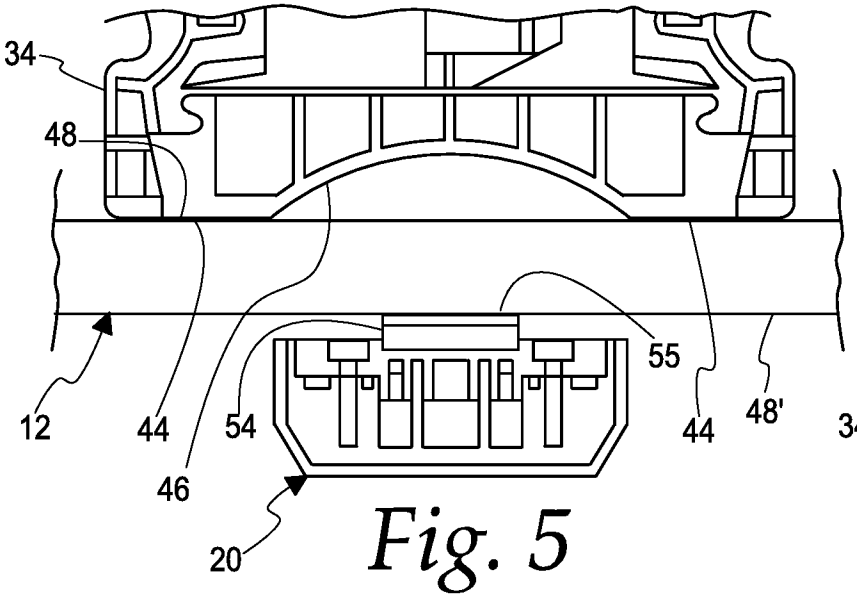
FIG. 5 is a partial section view taken along line 5-5 in FIG. 1.
Figure 6:
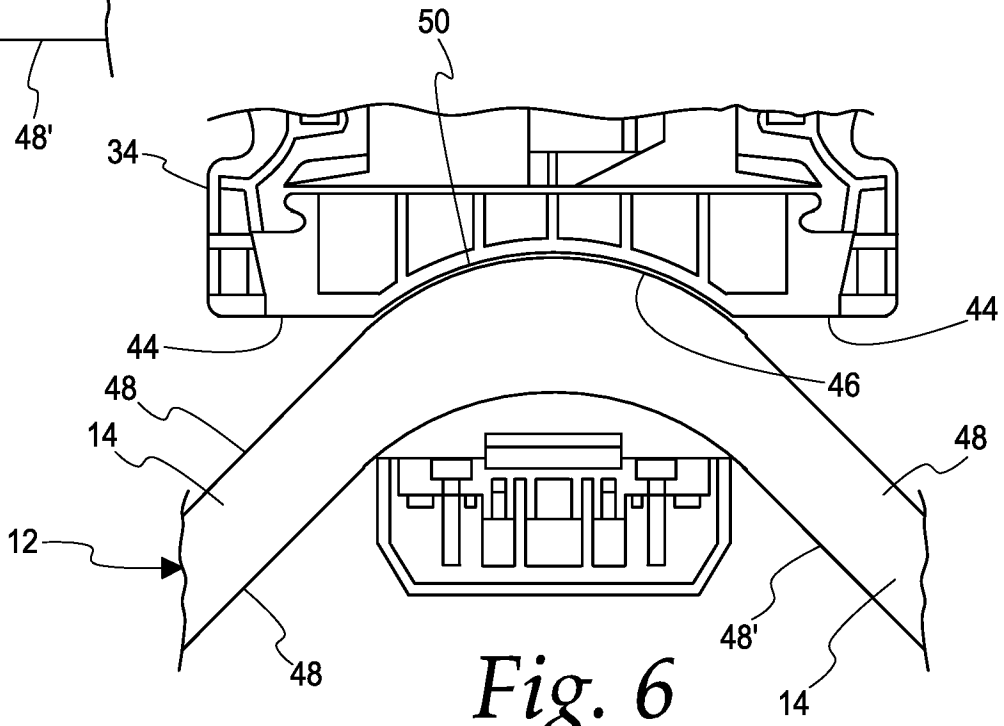
FIG. 6 is a partial section view taken along line 6-6 in FIG. 2.

As best seen in FIG. 5, the planar portions 44 are configured to engage planar surfaces on a lift bucket 12, and are particularly suited to engage an exterior planar surface of a sidewall 14, such as the surface 48. As best seen in FIG. 6, the concave portion 46 of the illustrated embodiment is arcuate and is configured to engage a convex surface of a lift bucket 12, and is particularly suited to engage an arcuate convex exterior surface at the corner of a sidewall 14, such as the surface 50.

Figure 4:
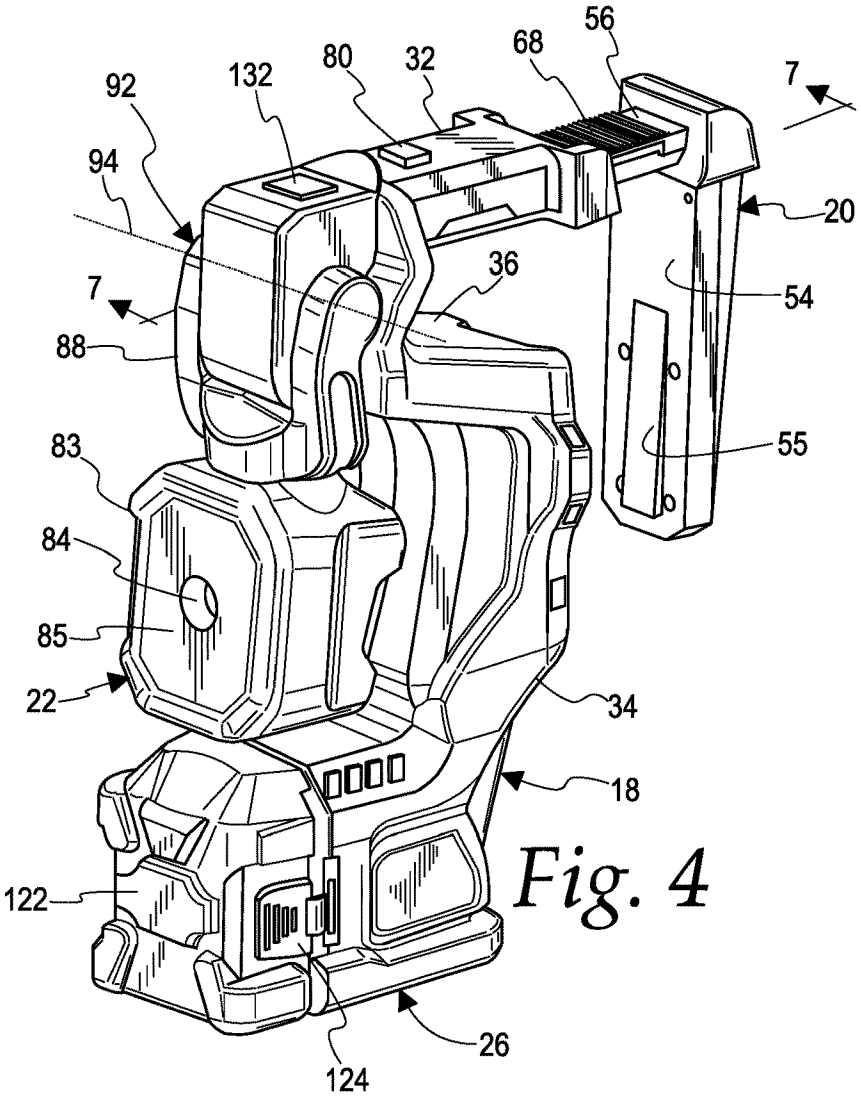
FIG. 4 is a perspective view from above and the front-left of the lighting device of FIGS. 1-3, again with the main light in the lower position and facing forward.

The securing member 20 includes a second securing surface 54 that, in the illustrated embodiment, is aligned opposite from the first securing surface 30, as best seen in FIG. 4. The securing member 20 extends downwardly from the upper housing portion 32 to locate the second securing surface 54 to engage a surface of a sidewall 14 on an opposite side from a surface of the sidewall 14 engaged by the first securing surface 30, as best seen in FIGS. 5 and 6. In the illustrated embodiment, the securing surface 54 includes an optional wedge shaped resilient portion 55 to increase the frictional engagement with a planar surface of a sidewall 14, such as the surface 48' in FIG. 5. The resilient portion 55 can be made from a suitable resilient material, such as a suitable elastomer including a suitable thermoplastic elastomer.

Figure 7:
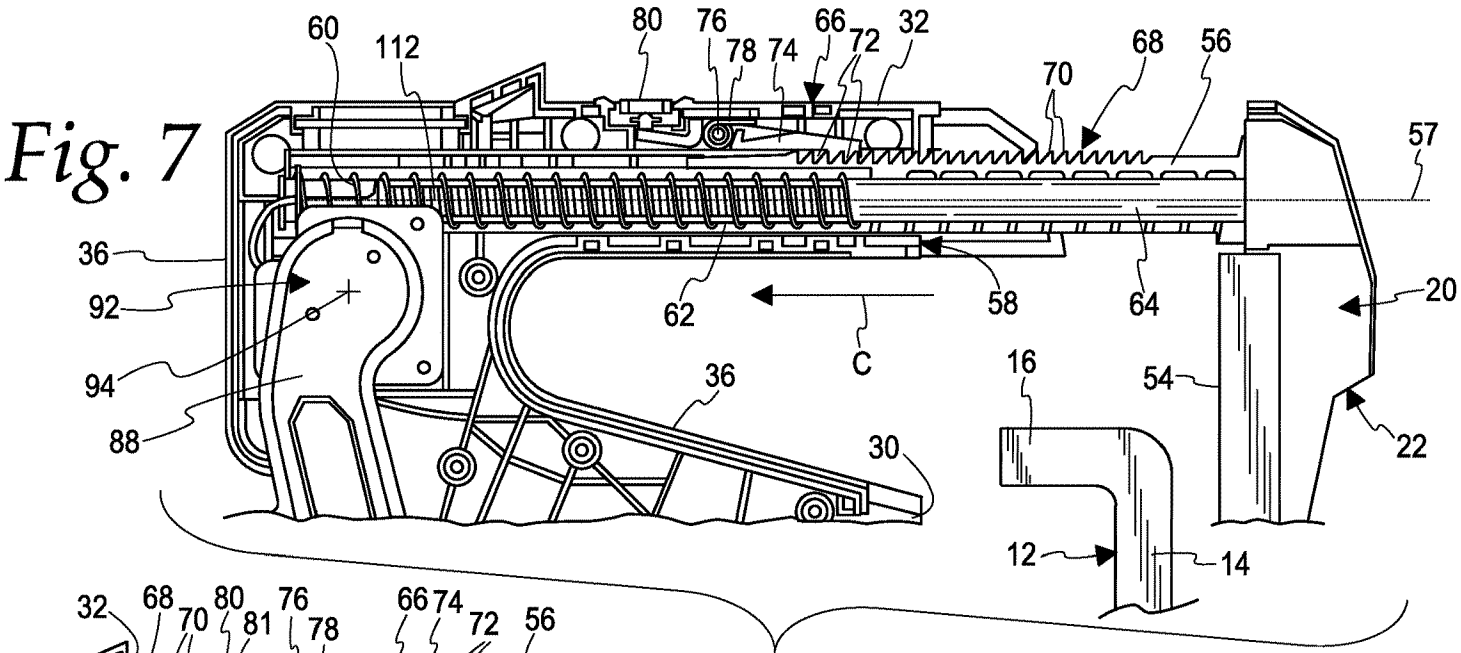
FIG. 7 is a partial section view taken along line 7-7 in FIG. 4 with a securing member of the lighting device shown in an open position and selected component shown unsectioned.

In the illustrated embodiment, the securing member 20 is a clamping member 20 and the securing surfaces 30 and 54 are clamping surfaces. The securing member 30 of the illustrated embodiment is mounted to the upper housing portion 32 to move between an open position, such as shown in FIGS. 3, 4, and 7, and a clamping position such as shown in FIGS. 1, 2, 5, and 6. In the open position, the securing member 20 is located to allow the securing surfaces 30 and 54 to be moved past the lip 16 so that a sidewall 14 can be inserted between the first securing surface 30 and the second securing surface 54, as best seen in FIG. 7. In the clamping position, the securing member 20 is located to clamp the sidewall 14 between the securing surfaces 30 and 54 with the upper housing portion 32 located above the lip 16, as best seen in FIGS. 1, 2, 5, and 6.

Figure 8:
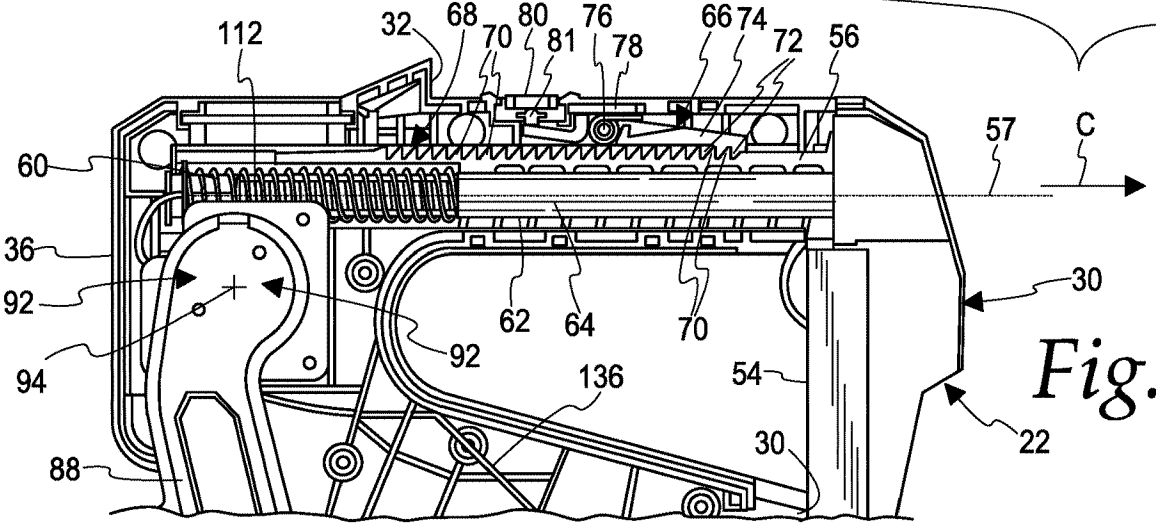
FIG. 8 is a view similar to FIG. 7 but showing the securing member in a fully closed position.

In the illustrated and preferred embodiment, the securing member 20 is mounted to the upper housing portion 32 to translate relative to the first securing surface 30 between the open and closed positions, as shown by the arrows C in FIGS. 7 and 8. In this regard, in the illustrated and preferred embodiment, the securing member 20 includes an elongate slide 56 that is mounted for guided translation along an axis 57 in a guide opening 58 defined in the upper housing portion 32. It is also preferred that the securing member 20 be biased to the open position, regardless of how it is mounted to move between the open and clamping positions. In this regard, in the illustrated embodiment and preferred embodiment, the lighting device 10 includes a helical compression spring 60 engaged between the upper housing portion 32 and the securing member 20 to bias the securing member 20 toward the open position. A pair of telescoping guide members 62 and 64 are provided in the illustrated embodiment and extend down the center of the helical spring 60, with the member 62 being fixed to the main housing 18 and the member 64 being fixed to the securing member 20 for movement therewith between the open and clamping positions. Both of the members 62 and 64 have a hollow cylindrical shape, with the member 64 being sized for guided translation within the cylindrical interior of the member 62. It should be appreciated that in the illustrated embodiments, the slide 56, guide opening 58, and members 62 and 64 all cooperate to provide the guided translation of the securing member 20 between the open and clamping position relative to the upper housing portion 32.

It is also preferred that the lighting device 10 include a mechanism 66 configured to selectively maintain the securing member 20 in the clamping position. In the illustrated embodiment, the mechanism 66 is provided in the form of a releasable ratchet mechanism 66 mounted between the securing member 20 and the upper housing portion 32. The illustrated ratchet mechanism 66 includes a linear rack 68 having a plurality of linearly spaced teeth 70 formed as a unitary part of the slide 56, and a pair of pawl teeth 72 fixed on a lever 74. The lever 74 is mounted via a pivot axis 76 to the upper housing portion 32. The lever 74 can pivot about the axis 76 between an engaged position wherein the pawl teeth 72 are engaged with teeth 70 on the rack 68 and a release position wherein the pawl teeth 72 are disengage from the teeth 70 on the rack 68. A helical torsion spring 78 is engaged between the lever 74 and the upper housing portion 32 to bias the lever 74 toward the engaged position. The teeth 70 and 72 are shaped so that movement of the securing member 20 toward the clamping position forces the lever 74 from the engaged position to the disengaged position, and movement of the securing member 20 toward the open position forces the teeth 70 and 72 into further engagement to retain the lever 74 in the engaged position. When the teeth 70 and 72 are disengaged, the spring 60 automatically moves the securing member 20 to the open position. The lighting device includes a release button 80 mounted in the upper housing portion 32 to actuate the lever 74 from the engaged position shown in FIG. 8 to the release position shown in FIG. 7 in response to the button 80 being pressed inwardly by a user against the force of a spring 81 that biases the button outwardly from the upper housing portion 32. To move the securing member 20 to the clamping position, a user pushes the securing member in the direction shown by arrow C in FIG. 7 against the bias force of the spring 60 and the teeth 70 and 72 will automatically force the lever 74 to the release position until the securing member is in the desired clamping position, depending on the thickness of the sidewalls 14, at which point the spring 78 will force the lever 74 to the engaged position where the teeth 70 and 72 are engaged.

Figure 12:
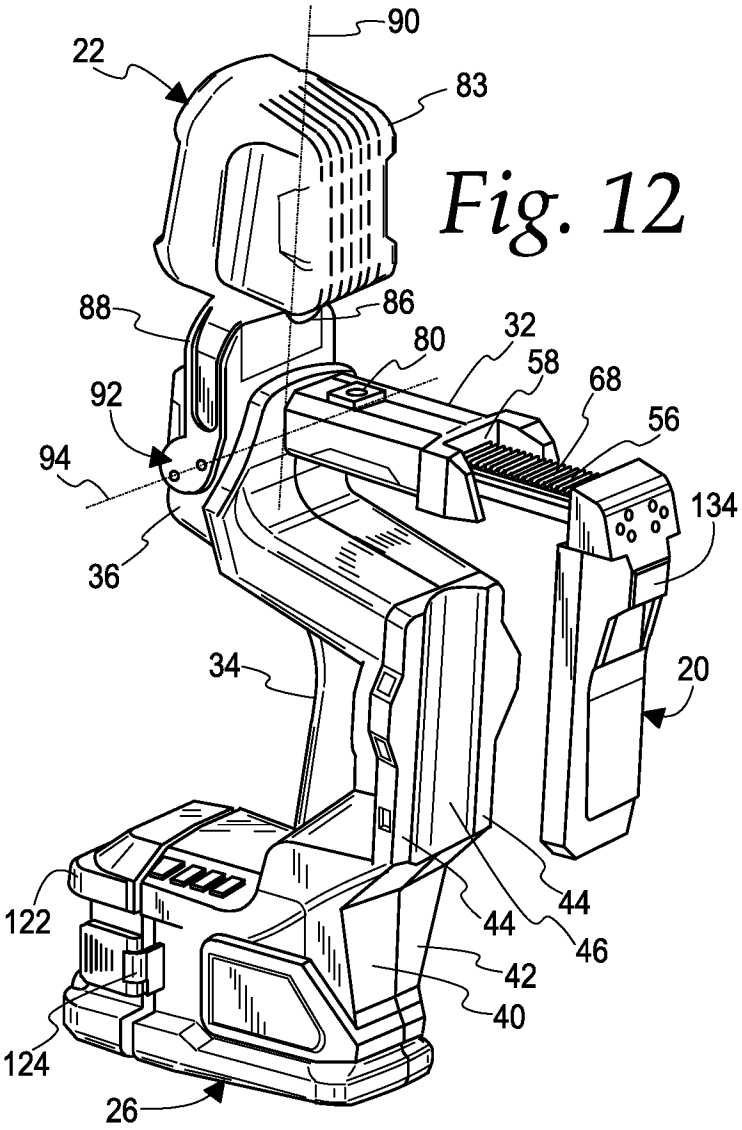
FIG. 12 is a view similar to FIG. 11 but showing the main light in an upper position and swiveled to face forward.

The main light 22 is mounted to the main housing 18 to move relative to the main housing 18 between a lower position wherein the main light 22 is positioned below the upper housing portion 32, such as shown in FIGS. 1, 3, 4,9, 10, 11, 13, and 14, and an upper position wherein the main light is positioned above the upper housing portion 32, such as shown in FIGS. 2 and 12. When the lighting device is mounted on a lift bucket 12, the lower position allows the main light 22 to illuminate areas outside of the lift bucket 12 without interfering with any overhead operations being performed by a line worker standing in the lift bucket 12. The upper position allows the main light 22 to illuminate other areas outside of the lift bucket 12 that otherwise would require the lighting device 10 to be repositioned on the lift bucket 12 so as to avoid the light from the main light 22 being blocked or otherwise interfered with by the sidewalls 14 and/or rim 16 of the lift bucket 12.

Figure 10:
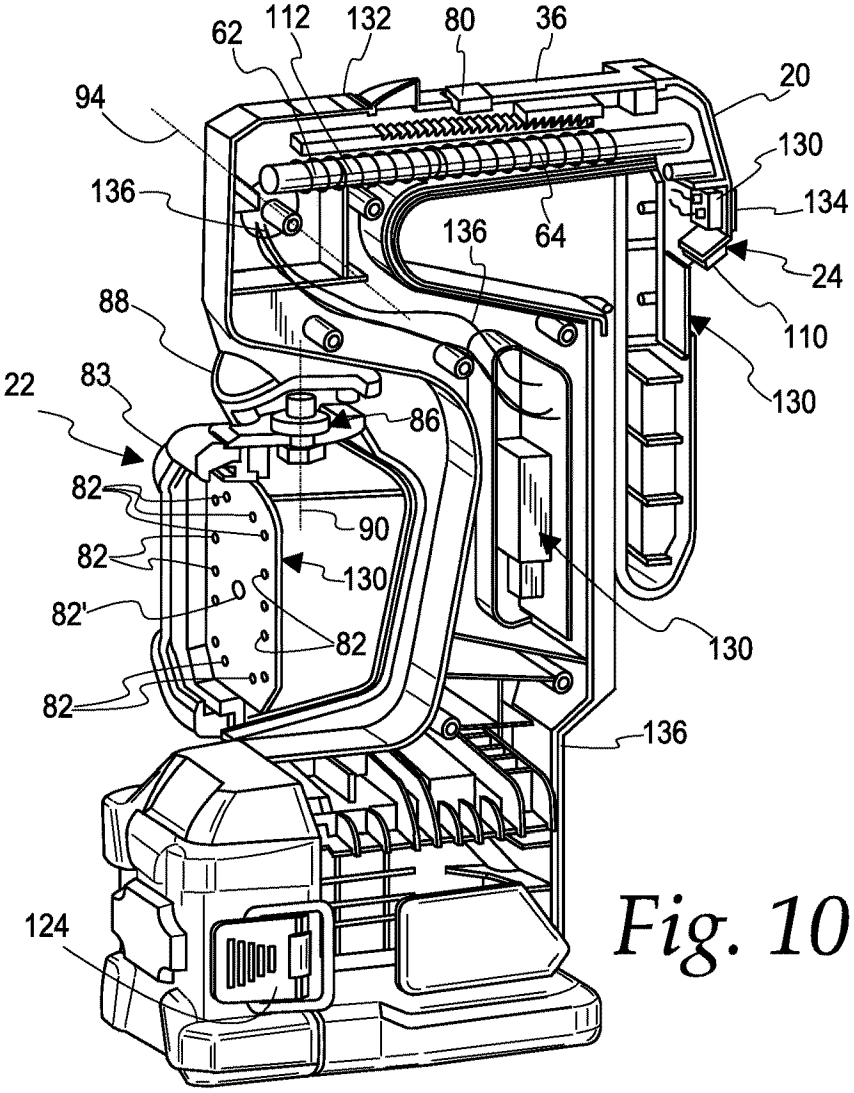
FIG. 10 is a perspective view from above and the front-left of the lighting device of FIGS. 1-9, with a housing component some housing components not shown for purposes of illustration and the main light in the lower position and facing forward.
Figure 9:
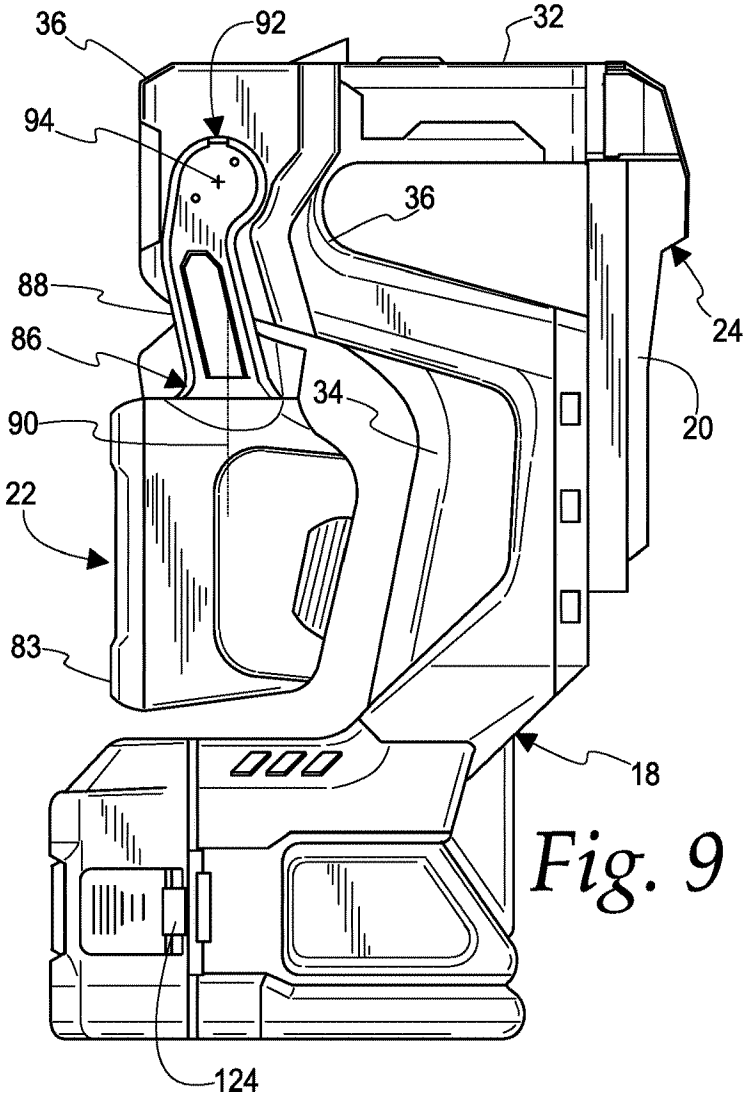
FIG. 9 is a left side elevation view of the lighting device of FIGS. 1-8 with the main light in the lower position and facing forward, and the right side elevation view being a mirror image of FIG. 9.
Figure 11:
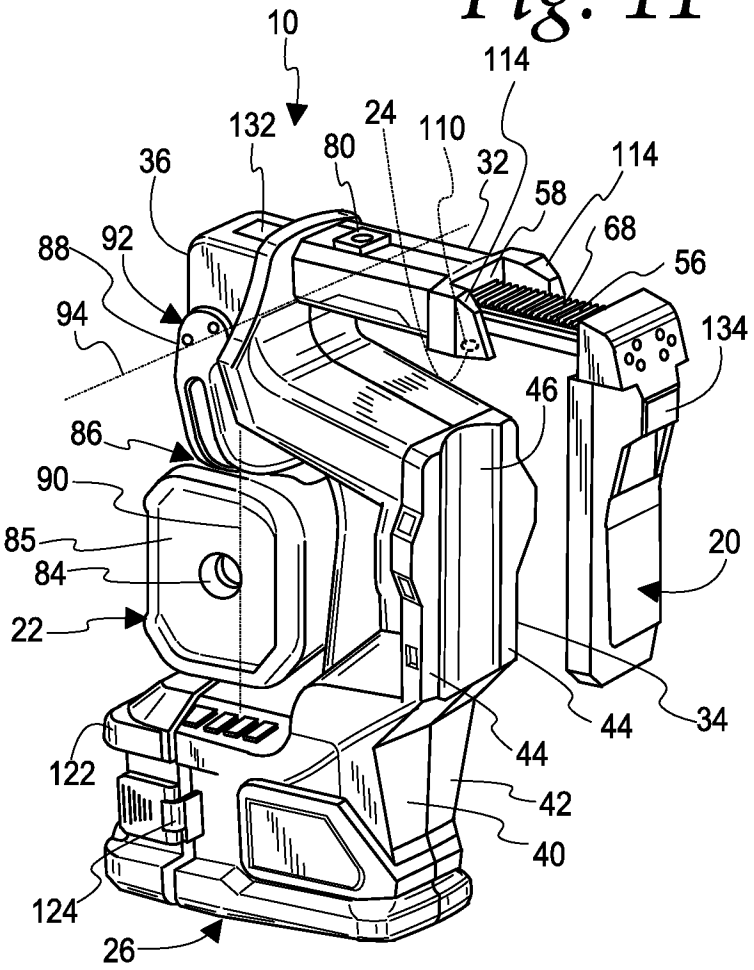
FIG. 11 is a perspective view from above and rear-left of the light device of FIGS. 1-10 with the main light in the lower position and swiveled to face left.

In the illustrated embodiment, as best seen in FIG. 10, the main light 22 includes an array of light emitting diodes ("LED's) 82 carried in a housing 83, with one of the LED's 82' located so that its light is focused by a spot light reflector/lens 84, best seen in FIG. 4, and the remaining LED's located to generate flood lighting through a lens 85. The housing 83 is mounted by a pivot mount 86 to a gimbal 88 to allow the housing 84 to pivot at least 330° about a first axis 90, and the gimbal 88 is mounted by a pivot mount 92 to the mount portion 36 of the main housing 18 to pivot at least 180° about a second axis 94 relative to the main housing 18. The movement of the gimbal 88 about the axis 94 allows the main light 22, and its led array 82 and housing 83, to move between the lower and upper positions as best seen in FIGS. 11 and 12. In the illustrated and preferred embodiments, the axes 90 and 94 are perpendicular to each other. The pivot mounts 86 and 92 can be of any suitable configuration, many of which are known, that for electrical power/control conduits to pass through the mounts 86 and 92 to provide power/control of the LED's 82 throughout the entire desired range of motion for the pivot mounts 86 and 92.

As best seen in FIG. 10, the interior light 24 of the illustrated embodiment includes an light emitting diode 110 that is fixed in the securing member 20 so that its light is directed at a downward and rearward angle to illuminate the interior of a lift bucket 12 to which the lighting device is attached. A coiled electrical power/control conduit 112 extends through the hollow interiors of the guide members 62 and 64 to provide power and control of the LED 110. The coils in the conduit 110 allow for the conduit 110 to extend and retract as the securing member 20 is moved between the open and clamping positions. In an alternate embodiment, the LED 110 can be mounted in an extension 114 of the upper housing portion 32 so that the interior light 24 is fixed in the upper housing portion 32 rather than the securing member 20, as shown in phantom in FIG. 11. As another alternative, another LED 110 can be mounted in another extension 114 of the upper housing portion 32 so that the interior light located in both extensions 114. It should be understood that for both of these alternatives, the conduit 112 wouldn't extend through guide members 62 and 64 and wouldn't need to be a coiled conduit because the LED(s) 110 would not have to move relative to the main housing 18. As yet a further alternative, the LED(s) 110 can be added to either or both of the extensions 114 as an addition to the LED 110 fixed in the securing member 20 so that the interior light 24 is fixed in both the upper housing portion 32 and the securing member 20.

Figure 14:
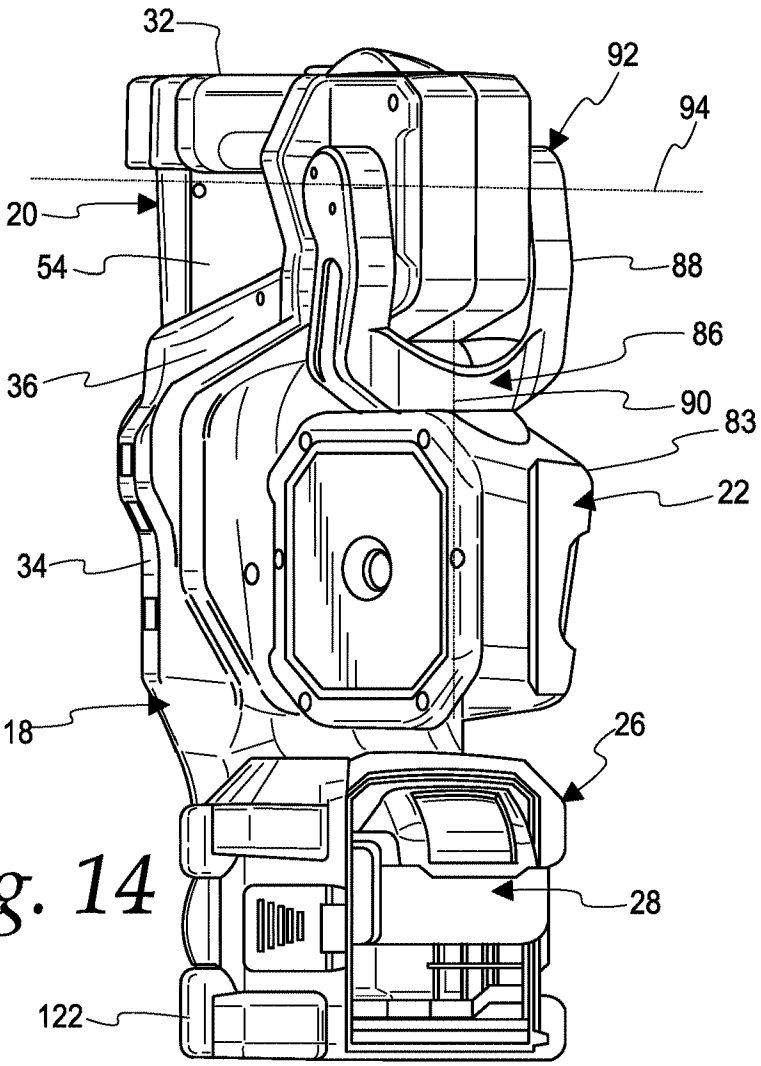
FIG. 14 is a perspective view from the front and the right of the lighting device of FIGS. 1-13 with the main light in the lower position and swiveled to face right and with the lid of the battery compartment in the open position and a battery installed in the compartment.
Figure 13:
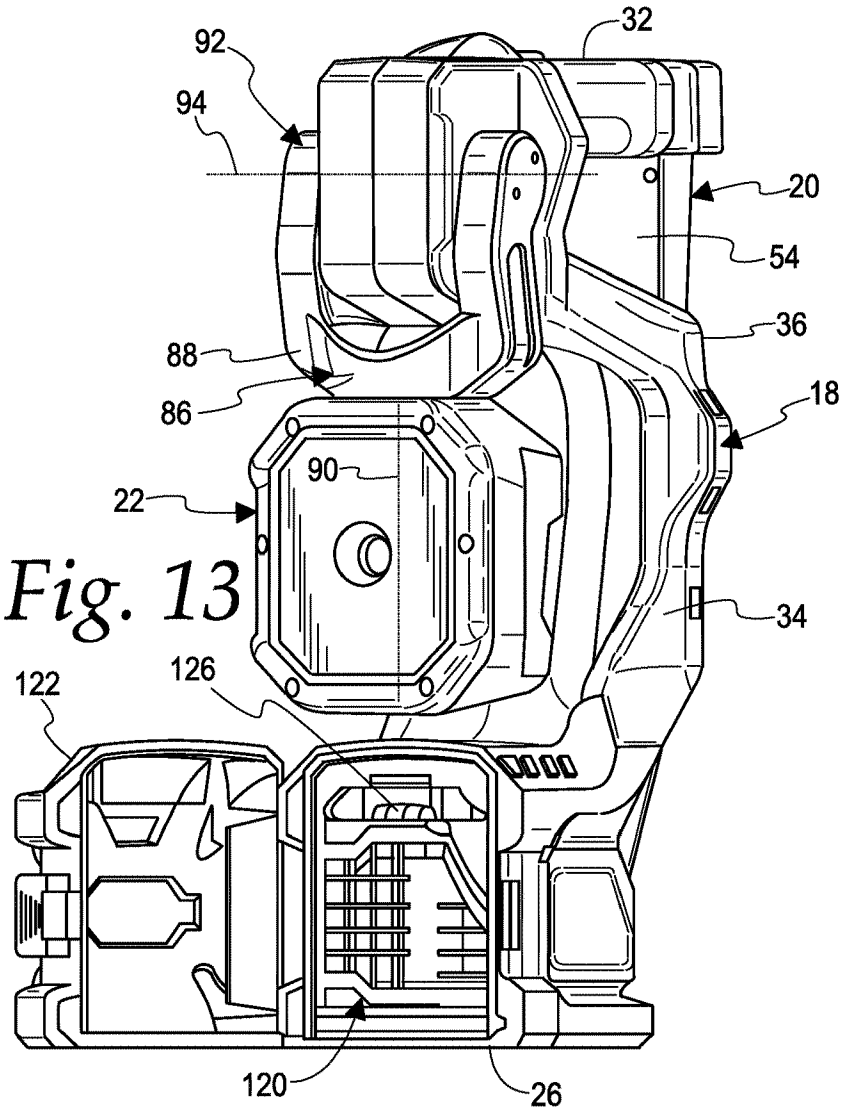
FIG. 13 is a perspective view from the front and the left of the lighting device of FIGS. 1-12 with the main light in the lower position and facing forward and a lid to a battery compartment shown in an open position.

As best seen in FIGS. 13 and 14, the battery mount portion 28 of the illustrated embodiment includes a battery compartment 120 and lid 122 that enclose the battery 28 when it is connected to the lighting device 10. For the illustrated embodiment, it is preferred that the battery 28 be a rechargeable 18 volt battery 28, many of which are known, that can be selectively connect and disconnected with the lighting device 10. The lid 122 can move between open and closed positions (open positions shown in FIGS. 13 and 14; closed position shown in FIGS. 1-4 and 9-12) to allow the battery 28 to be loaded into and removed from the compartment 120. A releasable latch 124 is provided to retain the lid 122 in the closed position. A suitable battery connector 126, many of which are known, is provided in the compartment 120 to releasably connect the battery 28 to an electrical system 128 of the lighting device 10. As best seen in FIG. 10, the electrical system 128 includes the conduit 112, one or more battery and led controllers and associated circuitry 130, a user operated control switch 132 to allow a user to selectively control the functions of the main light 22, a user operated switch 134 to allow a user to selectively control the functions of the interior light 24, and electrical power/control conduits 136 to connect the switches 132 and 134 and the battery 28 to the remainder of the electrical system 128.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the lighting device 10 are shown in the figures, it should be understood that this disclosure anticipates variations in the specific details of each of the disclosed components and features of the lighting device 10 and that no limitation to a specific form, configuration, or detail is intended unless expressly and specifically recited in an appended claim.

For example, while specific and preferred forms have been shown for the LED's 82 and 110, any suitable light emitting component, many of which are known, may be used for one or both, including for example, other configurations of LED arrays, single LED's, incandescent bulbs, xenon bulbs, or halogen bulbs. As another example, while the illustrated gimbal 88 and pivot mount 92 are preferred, any suitable structure that allows the main light 22 to move between the upper and lower positions can be used. Similarly, while the gimbal 88 and pivot mount 86 are preferred, any suitable structure that allows the main light 22 to swivel some amount relative to the main housing 18 in either the upper or the lower position can be used. As an example, while it is preferred that the main light 22 be configured to swivel some amount relative to the main housing 18 in both the upper and lower positions, in some application it may be desirable of the main light not to be configured to swivel in either the upper or the lower position, or to be able to swivel in only one of the upper and lower positions. In yet another example, while it is preferred that each light 22 and 24 be controlled by a dedicated switch, in some application it may be desirable for the lights 22 and 24 to be controlled by a single switch or other type of user input device. As another example, while it is preferred that the concave portion 46 have an arcuate profile, in some applications it may be desirable a different concave shape to be used, such as a v-shaped profile. As another example, while the disclosed ratchet mechanism 66 is preferred, any suitable mechanism 66 configured to selectively maintain the securing member 20 in the clamping position can be used. Similarly, while it is preferred to bias the securing member 20 to the open position, in some applications it may be desirable to not provide any bias force on the securing member 20 or to bias the securing member 20 toward the clamping position. In further example, while it is highly preferred that the securing member 20 be configured for movement relative to the main housing 18, in some applications it may be desirable for the securing member to have a fixed relationship relative to the main housing 18 with sufficient spacing between the securing member 20 and the main housing 18 to allow the lip 16 and/or the sidewall 14 to be inserted between the securing member 20 and the main housing 18 as the lighting device is mounted onto the lift bucket 12. In another example, while it is preferred that the portions 32 and 36 of the housing 18 define the u-shaped channel 38, other shapes can be used for the channel 38 and in some applications it may be desirable not to have a channel defined between the portions 32 and 36 of the housing 18. In a further example, while it is preferred for the battery mount portion 26 to be located at the bottom of the housing 18, in some applications it may be desirable to provide a different location in the main housing 18 for the battery mount portion 26 or for the securing member 20 to include a battery mount portion. Further, while it is preferred that the battery 28 be readily removable from the main housing 18, in some applications it may be desirable for the battery to be fixed in the main housing 18. As yet another example, while it is preferred that the interior light 22 have a fixed relationship to the securing member 20, in some applications it may be desirable to allow the interior light 22 to be configured for to move relative to the securing member 20. As another example, while the exterior cross-sectional shape of the slide 56 is illustrated as being somewhat trapezoidal shaped, many other shapes are possible, including for example circular, rectangular, and square shapes. As a further example, while the illustrated embodiment provides pivoting motion of the main light 22 between the upper and lower positions, in some application it may be desired for the motion to take some other form, such as, for example, could be provided by a slide in a vertically extending channel. As yet another example, while the illustrated and preferred embodiments are intended for engagement of the surfaces 30 and 54 with the sidewalls 14 of a lift bucket 12, it may be desirable in some applications to engage the lip 15 of a lift bucket 12 with the surfaces 30 and 54 of the illustrated embodiment, or to optimize the lighting device 10 and surfaces 30 and 54 for such engagement with the lip 15 of a lift bucket. As a further example, while the illustrated ratchet mechanism 66 shows the linear rack 68 as a unitary part of the slide 56, the rack 68 could be a separate component that is assembled to the slide 56. Furthermore as another alternate configuration, the rack 68 could be attached to or formed as a unitary part of the upper housing portion 32 and the lever 74 with the pawl teeth 72 could be pivot mounted to the slide 56.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. Directional terms such as upward, downward, upper, lower, etc. are intended to have their commonly understood meaning. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

What is claimed is:

1. A battery powered lighting device configured to be releasably attached to an aerial work platform in the form of a lift bucket having sidewalls and an upper lip extending from uppermost portions of the sidewalls, the lighting device comprising:

a main housing comprising:

a battery mount configured to mount a battery to power the lighting device, a first securing surface configured to engage a sidewall or the upper lip of the lift bucket, the first securing surface comprising a pair of planar portions spaced from each other by a concave portion, the planar portions configured to engage a planar surface of a sidewall or the upper lip of the lift bucket and the concave portion configured to engage a convex surface of a corner of the lift bucket, an upper housing portion configured to be located above the upper lip of the lift bucket with the first securing surface engaged against a sidewall or the upper lip of the lift bucket, wherein the concave portion is configured to extend vertically away from the upper housing portion;

a securing member comprising a second securing surface, the securing member extending from the upper housing portion to locate the second securing surface to engage a surface of a sidewall or the upper lip of the lift bucket on an opposite side from a surface of the sidewall or the upper lip engaged by the first securing surface; and a main light mounted to the main housing and located to illuminate areas outside of the lift bucket.

2. The lighting device of claim 1 wherein the securing member is mounted to the upper housing portion to move between:

an open position wherein a sidewall or the upper lip of the lift bucket can be inserted between the first and second securing surfaces; and a clamping position wherein the sidewall or the upper lip is clamped between the first and second securing surfaces with the upper housing portion located above the lip of the lift bucket.

3. The lighting device of claim 2 wherein the securing member is mounted to the upper housing portion to translate relative to the first securing surface.

4. The lighting device of claim 2 further comprising a releasable ratchet mechanism mounted between the securing member and the upper housing portion and configured to releasably retain the securing member in the clamping position.

5. The lighting device of claim 4 wherein the securing member is biased toward the open position.

6. The lighting device of claim 4 further comprising a spring mounted between the upper housing portion and the securing member and configured to bias the securing member toward the open position, and wherein the securing member is mounted to the upper housing to translate relative to the first securing surface.

7. The lighting device of claim 1 further comprising an additional light located on the device to illuminate an interior of the lift bucket with a sidewall or the upper lip of the lift bucket clamped between the first and second securing surface.

8. The lighting device of claim 1 wherein the main light is mounted to move relative to the main housing between a lower position wherein the main light is positioned below the upper housing portion and an upper position wherein the main light is positioned above the upper housing portion.

9. The lighting device of claim 1 wherein the battery mount comprises a compartment that encloses a battery mounted in the battery mount.

10. The lighting device of claim 1 further comprising a battery and wherein the battery mount comprises a releasable connection to allow the battery to be releasably connected to the lighting device.

11. The lighting device of claim 1 wherein the main light is an array of light emitting diodes.

12. The lighting device of claim 1 wherein the concave portion has an arcuate profile.

13. The light device of claim 1 wherein the second securing surface is aligned opposite the first securing surface.

14. A battery powered lighting device configured to be releasably attached to an aerial work platform in the form of a lift bucket having sidewalls and an upper lip extending from uppermost portions of the sidewalls, the lighting device comprising:

a main housing comprising:

a battery mount configured to mount a battery to power the lighting device, a first clamp surface configured to engage a sidewall or the upper lip of the lift bucket, the first clamp surface comprising a pair of planar portions spaced from each other by a vertically extending concave portion, the planar portions configured to engage a planar surface of a sidewall or the upper lip of the lift bucket and the vertical extending concave portion configured to engage a vertical extending convex surface of a sidewall or the upper lip located at a corner of the lift bucket, an upper housing portion configured to be located above the upper lip of the lift bucket with the first clamp surface engaged against a sidewall or the upper lip of the lift bucket;

a clamp member comprising a second clamp surface, the clamp member mounted to the upper housing portion to move between an open position wherein a sidewall or the upper lip of the lift bucket can be inserted between the first and second clamp surfaces and a clamping position wherein the sidewall or the upper lip is clamped between the first and second clamp surfaces with the upper housing portion located above the lip of the lift bucket; and a main light mounted to the main housing and located to illuminate areas outside of the lift bucket.

15. The lighting device of claim 14 wherein the clamp member is mounted to the upper housing to translate relative to the first clamp surface.

16. The lighting device of claim 14 further comprising a releasable ratchet mechanism mounted between the clamp member and the upper housing portion and configured to releasably retain the clamp member in the clamping position, the ratchet mechanism comprising:

an elongate, multi-toothed rack mounted to one of the clamp member and the upper housing portion, and a pawl mounted to the other of the clamp member and the upper housing portion.

17. The lighting device of claim 16 wherein the clamp member is biased toward the open position.

18. The lighting device of claim 16 further comprising a spring mounted between the upper housing portion and the clamp member and configured to bias the clamp member toward the open position, and wherein the clam900p member is mounted to the upper housing to translate relative to the first clamp surface.

19. The lighting device of claim 14 further comprising an additional light located on the device to illuminate an interior of the lift bucket with a sidewall or the upper lip of the lift bucket clamped between the first and second clamp surface.

20. The lighting device of claim 14 wherein the main light is mounted to move relative to the main housing between a lower position wherein the main light is positioned below the upper housing portion and an upper position wherein the main light is positioned above the upper housing portion.

* * * * *